US008246344B1

(12) United States Patent
Schrock

(10) Patent No.: US 8,246,344 B1
(45) Date of Patent: Aug. 21, 2012

(54) GAS LAMP

(76) Inventor: Samuel Schrock, Arthur, IL (US)

( * ) Notice: Subject to any disclaimer, the term of this patent is extended or adjusted under 35 U.S.C. 154(b) by 0 days.

(21) Appl. No.: 10/866,417

(22) Filed: Jun. 14, 2004

Related U.S. Application Data

(60) Provisional application No. 60/490,466, filed on Jul. 29, 2003.

(51) Int. Cl.
*F23D 14/62* (2006.01)
*F21L 19/00* (2006.01)

(52) U.S. Cl. ..... 431/109; 431/354; 431/100

(58) Field of Classification Search ..... 431/328, 431/329, 354, 100–113, 344, 345, 346; 126/39 R, 126/265–267, 248–256, 85 R, 92 R, 92 AC, 126/92 B, 85 A, 214 R; 362/179, 266
See application file for complete search history.

(56) References Cited

U.S. PATENT DOCUMENTS 221,758 A * 11/1879 Westphal ..... 431/278
574,805 A * 1/1897 Kern ..... 431/110
611,914 A * 10/1898 Kern ..... 431/110
633,518 A * 9/1899 Kern ..... 431/110
640,752 A * 1/1900 Cowles ..... 431/110
647,692 A * 4/1900 Blackman ..... 431/106
650,858 A * 6/1900 Murinick ..... 431/110
660,580 A * 10/1900 Little, Jr. ..... 431/108
681,851 A * 9/1901 Gordon ..... 431/105
713,421 A * 11/1902 Fouche ..... 431/346
713,768 A * 11/1902 Keith ..... 431/110
717,747 A * 1/1903 Humphrey ..... 431/110
733,160 A * 7/1903 Columbus ..... 431/110
829,285 A * 8/1906 Palmer ..... 171/103
871,726 A * 11/1907 Morin ..... 360/86
879,247 A 2/1908 Davidson
880,797 A * 3/1908 Humphrey ..... 431/109
884,012 A * 4/1908 Farnoff ..... 431/109
888,097 A * 5/1908 Koons ..... 432/64
917,728 A 4/1909 Hare
942,831 A * 12/1909 Humphrey ..... 431/346
953,836 A * 4/1910 Humphrey ..... 431/109
955,874 A * 4/1910 Humphrey ..... 431/109
985,261 A * 2/1911 Humphrey ..... 431/113
1,015,564 A * 1/1912 Humphrey ..... 431/109
1,021,805 A * 4/1912 Schodt ..... 431/110
1,043,182 A * 11/1912 Wiederhold ..... 431/109
1,051,593 A * 1/1913 Humphrey ..... 431/109
1,070,875 A * 8/1913 Coventry ..... 431/109
1,097,719 A * 5/1914 Humphrey ..... 362/266
1,145,188 A 7/1915 Franz
1,184,892 A * 5/1916 Tappan ..... 431/346
1,190,660 A * 7/1916 McKenna ..... 431/113
1,202,079 A * 10/1916 Lyon ..... 431/109
1,207,031 A * 12/1916 Hanson ..... 431/107
1,222,627 A * 4/1917 Humphrey ..... 431/109
1,244,051 A * 10/1917 Humphrey ..... 431/109
1,281,300 A 10/1918 Cross
1,327,447 A * 1/1920 Stites et al. ..... 431/100

(Continued)

FOREIGN PATENT DOCUMENTS

EP 0 757 184 * 2/1997

(Continued)

*Primary Examiner* — Carl Price
(74) *Attorney, Agent, or Firm* — Singleton Law Firm P.C.

(57) ABSTRACT

The invention relates to an improvement for a low pressure gas lamp, and more specifically for a venturi tube in order to furnish a more efficient flame.

17 Claims, 3 Drawing Sheets

U.S. PATENT DOCUMENTS 1,473,844 A * 11/1923 Garbarini ..... 126/96
1,506,964 A * 9/1924 Antrim ..... 126/92 B
2,057,216 A * 10/1936 Sonner ..... 431/346
2,450,790 A * 10/1948 Greaves ..... 239/427.3
2,452,438 A * 10/1948 Davis ..... 431/113
3,058,515 A * 10/1962 Rein et al. ..... 431/346
3,131,872 A * 5/1964 Hoenisch ..... 362/179
3,155,142 A * 11/1964 Stack ..... 431/328
3,233,653 A * 2/1966 Nakamura et al. ..... 431/329
3,554,182 A * 1/1971 Whitacre et al. ..... 126/376.1
3,635,644 A * 1/1972 Reid, Jr. ..... 431/9
3,684,189 A * 8/1972 Reed et al. ..... 239/425.5
3,737,652 A * 6/1973 Loveless ..... 362/266
3,885,907 A * 5/1975 Teague, Jr. ..... 431/328
3,984,196 A * 10/1976 Zenkner ..... 431/5
4,125,097 A * 11/1978 Gunderson ..... 123/406.66
4,338,888 A * 7/1982 Gerstmann et al. ..... 122/18.4
4,475,882 A * 10/1984 Gruner ..... 431/111
4,569,329 A * 2/1986 Cherryholmes ..... 126/92 B
4,782,814 A * 11/1988 Cherryholmes ..... 126/92 B
4,886,446 A * 12/1989 Courrege ..... 431/329
5,018,963 A * 5/1991 Diederich ..... 431/1
5,052,920 A * 10/1991 Warren et al. ..... 431/354
5,060,629 A * 10/1991 Sirand ..... 126/92 B
5,249,953 A * 10/1993 Roth ..... 431/7
5,402,567 A 4/1995 Riehl
5,431,346 A 7/1995 Sinaisky
5,522,722 A 6/1996 Diederich
5,549,099 A * 8/1996 Sirand ..... 126/92 B
5,567,148 A * 10/1996 Krueger et al. ..... 431/354
5,601,357 A * 2/1997 Rangarajan ..... 362/179
5,676,539 A 10/1997 Draper
5,791,893 A 8/1998 Charles, Sr. et al.
5,816,235 A * 10/1998 Kim et al. ..... 126/39 H
5,971,026 A * 10/1999 Beran ..... 137/888
5,980,238 A 11/1999 Collins, Sr.
6,033,212 A 3/2000 Bonnema et al.
6,364,657 B1 4/2002 O'Donnell
6,371,753 B1 4/2002 O'Donnell et al.
6,482,000 B2 11/2002 Sestrap
6,860,734 B2 * 3/2005 Zia et al. ..... 431/354

FOREIGN PATENT DOCUMENTS

JP 04-184139 * 7/1992

* cited by examiner

GAS LAMP

CROSS-REFERENCE TO RELATED APPLICATIONS

This application claims the benefit of provisional application 60/490,466, dated Jul. 29, 2003.

BACKGROUND OF THE INVENTION

The invention relates to an improvement for a gas lamp, and more specifically for a venturi tube in order to furnish a more efficient flame.

DESCRIPTION OF THE PRIOR ART

Gas lamps are an ancient technology. Modern usage of gas lamps is often found in camping settings or homes without electricity.

U.S. Pat. No. 5,971,026 to Beran discloses a Venture tube-like gas-air mixing valve for boilers.

U.S. Pat. No. 5,052,920 to Warner discloses a range top gas burner and air mixing apparatus.

These burner devices are not appropriate for the low pressure gas used for lighting.

SUMMARY OF THE INVENTION

The present invention provides an improved venturi tube for maximizing the efficiency of a low-pressure gas lamp. This is particularly important in homes, cabins, and other applications where the gas supply is delivered under relatively low pressures. An embodiment of the present invention uses gas at 11 inches of water column, equivalent to approximately 0.4 pounds per square inch (p.s.i.). This amount is considered low-pressure because it is less than a common required pressure of 10 p.s.i. for similar lamps. At low pressures, it is difficult to get a very bright flame from the slow supply of gas. It is an object of this invention to provide a burner tube to provide a venturi effect and produce the highest efficiency in the lamp.

By the design of the tapers and the lengths, the brightness is greatly improved and the pressure of gas required is greatly diminished. The use of low pressure has dramatic benefits for safety in camping and homes using the lamps.

The lamp also uses the venturi effect to burn to low-pressure gas more efficiently to produce a flame approximately twice as bright as similar products.

DETAILED DESCRIPTION OF THE INVENTION

Figure 1:
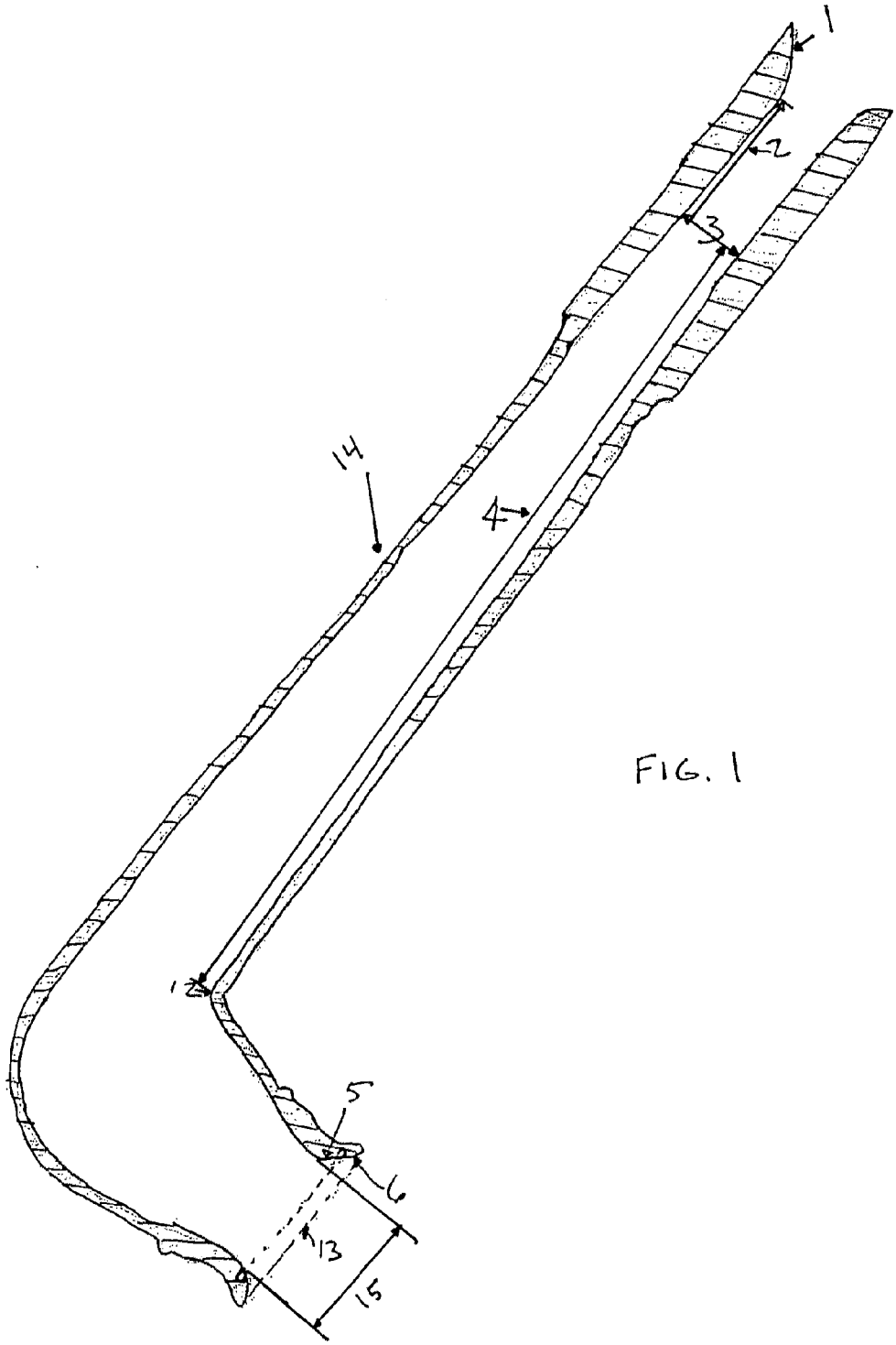
FIG. 1 is a cross-section of a burner tube of the present invention.

As shown in FIG. 1, the present invention discloses a burner tube 14 having an inlet section 1, where gas enters the burner tube. A common gas for this application is propane, however other gases are used.

As the gas enters the burner tube, a slightly tapered section 2 narrows the opening of the burner tube. At the narrowest point 3, the opening begins to open and get wider. This produces a venturi effect on the gas, drawing it through the burner tube and preventing the flame from backing into the supply line. The length of the burner tube should be between approximately 4 and 11 inches from the inlet section 1 to the turning point 12 for maximum efficiency of the venturi effect.

Figure 2:
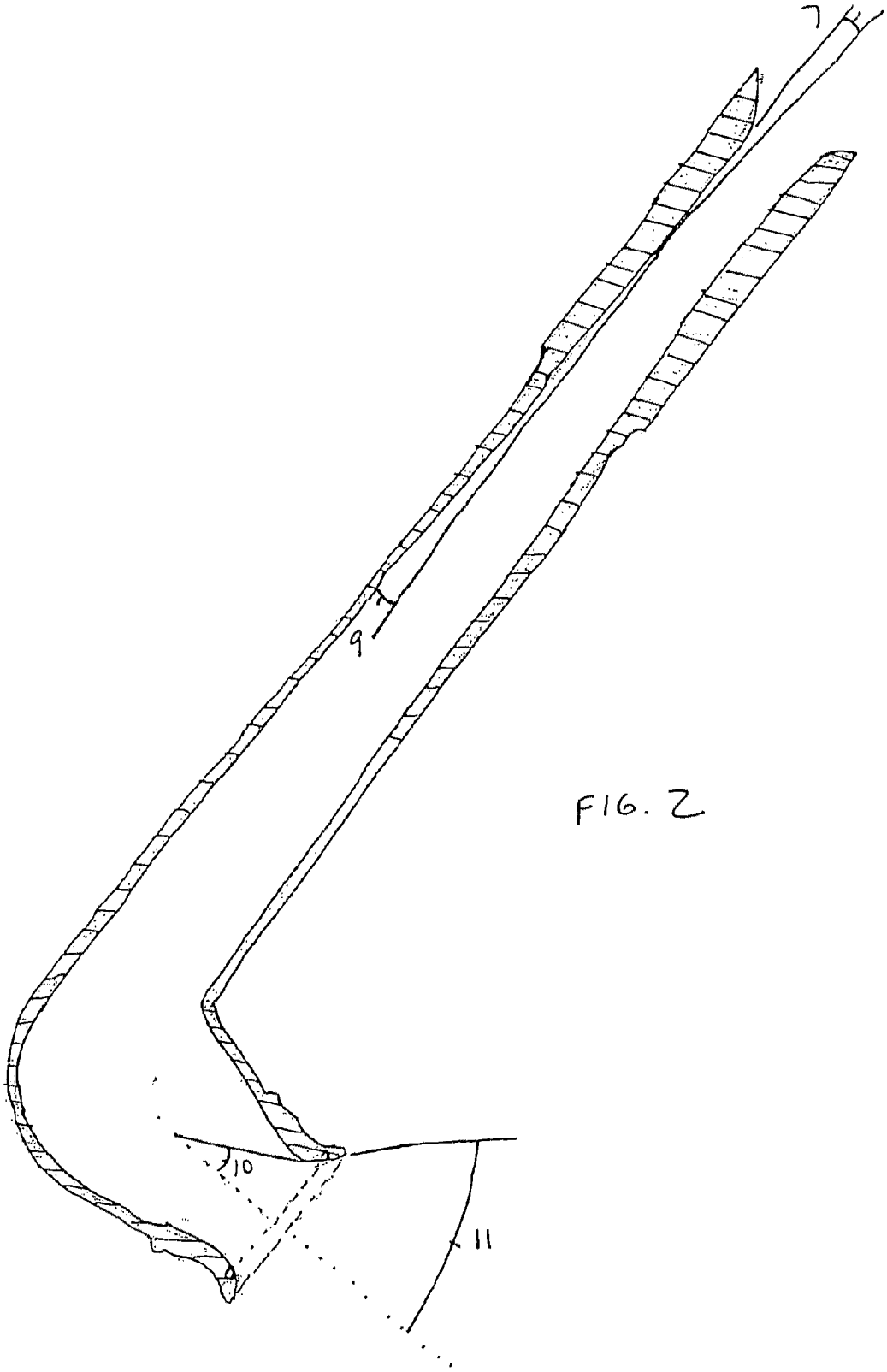
FIG. 2 is a cross-section of a burner tube of the present invention showing the taper angles.

As shown in FIG. 2, the first tapered section 2 has an angle of taper 7 of 1 to 4 degrees. A preferred taper has been found to be 1.5 degrees. When the gas passes the narrowest point 3, the burner tube opening should be 0.375 to 0.625 inches in diameter for a typical home gas pressure using a low-pressure system. A preferred opening is approximately 0.5 inches in diameter to achieve the proper air-gas mixture.

A long second tapered section 4 expands the diameter of the opening as the gas passes through the burner tube. The angle of the second taper 9 should be approximately 2 degrees for maximum efficiency. A range of 1 to 4 degrees can be utilized with success.

After the gas passes the turning point 12, the opening tapers to slightly smaller than the size of the screen assembly 13 at the outlet 15. The screen assembly 13 is held in place by notches in the burner tube. Once the opening tapers to its narrowest point at the outlet, a first outlet taper 5 and a second outlet taper 6 help keep the flame from coming back into the burner tube. The first outlet taper angle 10 should be approximately 20 to 40 degrees, with a preferred angle of about 30 degrees. The second outlet angle 11 should be approximately 40 to 70 degrees. A mantle assembly is attached to the end of the burner tube to produce a bright light.

Figure 3:
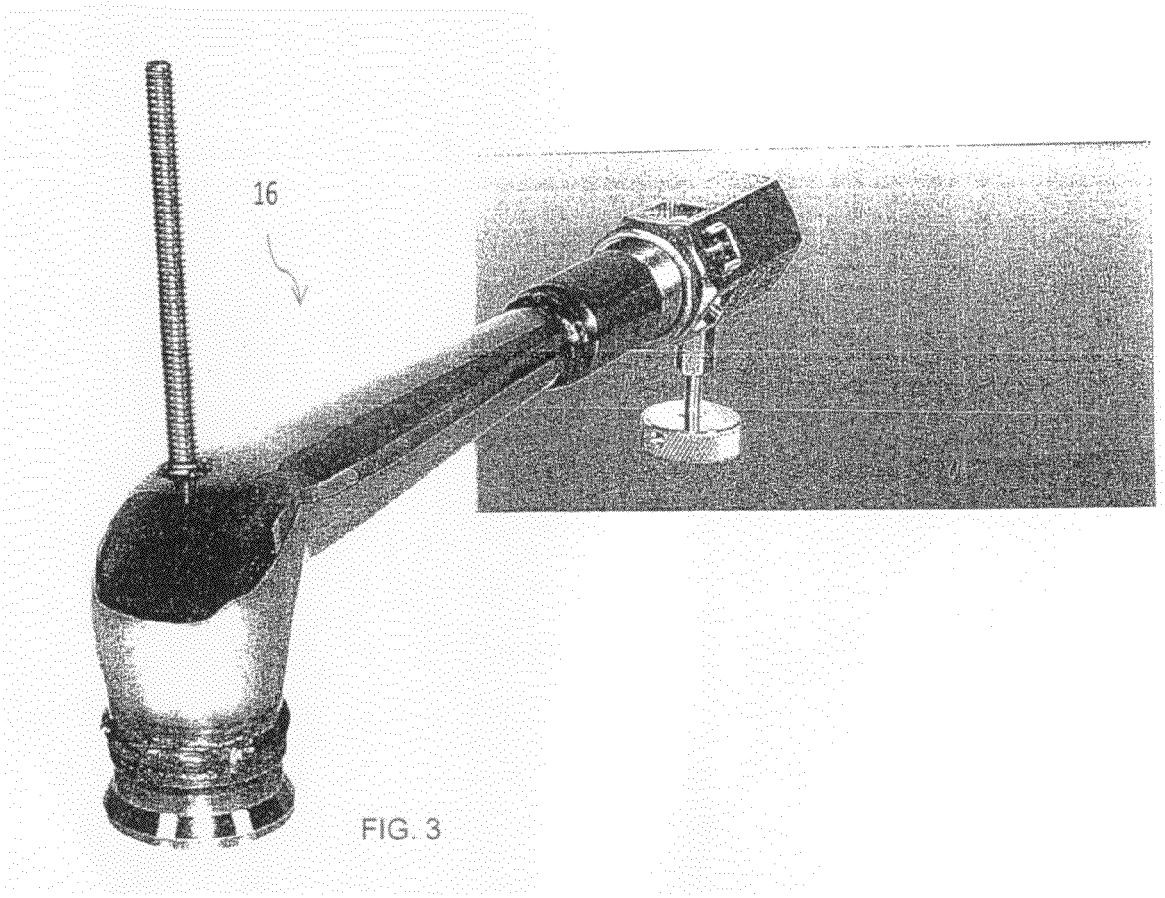
FIG. 3 is a perspective view of a completed lamp shown without a shade or wick.

By example, an embodiment of the gas lamp 16 as shown in FIG. 3 was connected to a standard low pressure propane gas system having a pressure of approximately 11 inches of water column or approximately 0.4 p.s.i. The lamp produced 600 lux or 55 foot-candle at a light meter approximately 25 inches from the lamp. The prior art lamp most commonly used in the low pressure system is known as the Humphrey lamp and still sold after more than 90 years. The same testing set up was used on a Humphrey lamp and the resulting light was only approximately 75 lux or 7 foot-candle.

The preferred embodiment has been shown and described and minor variations may be made by one skilled in the art. It is intended to cover all such variations as fall withing the scope and spirit of the claims.

I claim:

1. An L-shaped burner tube for use in a gas lamp, said burner tube comprising a long and short arm, said long arm comprises:

(a) an inlet section having an opening where gas enters the burner tube, (b) a first taper section adjoining said inlet section, said first tapered section having an opening that narrows to a first narrowest point of about 0.375 to 0.625 inches in diameter at an angle of taper of about 1 to about 4 degrees, (c) a second tapered section adjoining said first tapered section, said second tapered section having an opening that expands from said first narrowest point to a turning point at an angle of taper of about 1 to about 4 degrees; and said short arm comprises:

(a) a third tapered section having a wide opening at said turning point that narrows toward the burner tube outlet to a second narrowest point, and (b) an outlet section adjoining the third taper section, said outlet section having an opening that widens towards the terminus of the burner tube at an outlet angle of about 20 to 40 degrees.

2. The burner tube of claim 1, wherein said outlet angle is about 30 degrees.

3. The burner tube of claim 2, wherein said outlet section further comprises a second outlet angle of about 40 to 70 degrees.

4. The burner tube of claim 3, wherein the opening at said first narrowest point has a diameter of about 0.5 inches.

5. The burner tube of claim 4, wherein said first tapered section has an angle of taper of about 1.5 degrees.

6. The burner tube of claim 5, wherein the length from the entrance of the inlet section to the turning point is about 4 to about 11 inches.

7. The burner tube of claim 6, wherein said second tapered section has an angle of taper of about 2 degrees.

8. A gas lamp comprising the L-shaped burner tube of claim 7.

9. A gas lamp comprising the L-shaped burner tube of claim 1.

10. The burner tube of claim 1, wherein said outlet section further comprises a second outlet angle of about 40 to 70 degrees.

11. The burner tube of claim 1, wherein the opening at said first narrowest point has a diameter of about 0.5 inches.

12. The burner tube of claim 1, wherein the length from the entrance of the inlet section to the turning point is about 4 to about 11 inches.

13. The burner tube of claim 1, wherein said first tapered section has an angle of taper of about 1.5 degrees.

14. The burner tube of claim 1, wherein said second tapered section has an angle of taper of about 2 degrees.

15. The burner tube of claim 1, wherein said first tapered section has an angle of taper of about 1.5 degrees and said second tapered section has an angle of taper of about 2 degrees.

16. The gas lamp of claim 8, which produces at least about 600 lux at a light meter about 25 inches from the lamp when connected to a propane gas source having a pressure of about 0.4 pounds per square inch.

17. The gas lamp of claim 9, which produces at least about 600 lux at a light meter about 25 inches from the lamp when connected to a propane gas source having a pressure of about 0.4 pounds per square inch.

* * * * *